US005754107A

United States Patent [19]

Ferrantelli

[11] Patent Number: 5,754,107

[45] Date of Patent: May 19, 1998

[54] PRESSURE ACTUATED DEAD BOLT PREMISES INTRUSION ALARM AND INTRUDER

[76] Inventor: Salvatore Ferrantelli, 26 Horton Ave., Valley Stream, N.Y. 11581

[21] Appl. No.: 802,325

[22] Filed: Feb. 18, 1997

[51] Int. Cl.[6] ..... G08B 13/06

[52] U.S. Cl. ..... 340/542; 340/545

[58] Field of Search ..... 340/542, 545

[56] References Cited

U.S. PATENT DOCUMENTS

| | | | |
|---|---|---|---|
| 2,286,463 | 6/1942 | Chaskin | 340/542 |
| 3,623,062 | 11/1971 | Hawkins | 340/542 |
| 3,755,802 | 8/1973 | Bobrowski et al. | 340/542 |
| 3,866,203 | 2/1975 | Berns | 340/542 |
| 4,360,803 | 11/1982 | Heiland | 340/542 |
| 5,191,314 | 3/1993 | Ackerman et al. | 340/542 |
| 5,268,671 | 12/1993 | Novotny | 340/545 |
| 5,311,168 | 5/1994 | Pease, Jr. et al. | 340/542 |
| 5,347,262 | 9/1994 | Thurmond et al. | 340/572 |
| 5,354,157 | 10/1994 | Wells et al. | 409/133 |
| 5,461,365 | 10/1995 | Schlager et al. | 340/573 |
| 5,469,139 | 11/1995 | Ko | 340/545 |
| 5,489,890 | 2/1996 | Moser | 340/545 |
| 5,539,378 | 7/1996 | Chang | 340/542 |

*Primary Examiner*—Glen Swann

*Attorney, Agent, or Firm*—Mark E. Bender, Attorney

[57] ABSTRACT

In an apparatus and method for deterring and preventing forced entry intrusion into residential and commercial premises, the apparatus is a combination vertically operated dead bolt door lock surrounded by an alarm housing having battery means, a loud speaker, and a contact switch. The lock striker plate is mounted to the door frame as usual, but the lock is not mounted to the door at all, but rather is attached in suspension within the alarm housing. The alarm housing is attached to the door, and the lock within the housing is offset so as to float in spaced-apart relationship from the door on which the alarm housing is installed. Upon an intrusion effort, the door, together with the alarm housing will be shoved inward toward the premises by the intruder. But the lock floating within the alarm housing will be restrained by its engagement with the striker plate mounted to the door frame. Because the lock is restrained from moving but the alarm housing is not, there will be relative movement therebetween, restrained only by resilient spring washers upon the screws mounting the lock to the alarm housing. When the resilience of the spring washers is overcome by the force applied by the intruder, there will be motion of the lock relative to the alarm housing, in turn causing an electrical alarm contact switch to activate a piercing alarm sound, and causing the intruder to be deterred from continuing to try to force entry to the premises.

18 Claims, 7 Drawing Sheets

PRESSURE ACTUATED DEAD BOLT PREMISES INTRUSION ALARM AND INTRUDER

BACKGROUND OF THE INVENTION

Burglary and forced entry premises intrusion has become a problem of modern life not limited to urban apartment dwellers, and is an acute problem shared by both residential and commercial premises occupants and owners. To solve the problem a variety of alarms and intrusion prevention hardware have been developed, some of which seek to prevent a forced entry by reinforcing a premises access door and some of which seek to deter intrusion by sounding or transmitting an alarm. Some alarms produce sound and/or light, while others send an output to a remote receiving location, such as a law enforcement or security organization.

What has been needed, and what the present invention provides, is an inexpensive but highly effective combination door lock and intrusion alarm which creates its alarm sound if a force is applied on the door on which it is mounted by an intruder, but which will not give a false alarm when the locked door is put under an ordinary stress, such as the force of a person leaning against it and not actively attempting to force the door open in spite of existing lock hardware.

What has also been needed in the past, and which the present invention provides, is a combination of alarm and door lock which is simple, which is inexpensive, which takes advantage of existing, well-known dead bolt door lock hardware and which functions in a manner which is completely novel, and is also highly effective and highly reliable.

Relevant art includes U.S. Pat. No. 4,360,803 to Heiland which discloses a door lock assembly with an electrical alarm. While the Heiland '803 patent provides a door lock assembly having an electrical alarm system. Heiland '830 employs a piezoelectric pressure sensor which the present invention does not require—the present invention instead uses a simpler electrical contact switch. But also very important is the distinction between the present invention and Heiland '803 in that Heiland requires a lateral-throw deadbolt—which moves laterally between its open and locked positions—whereas the present invention specifically requires the use of a vertically operable deadbolt as further explained and described herein.

Furthermore, the present invention utilizes resilient Belleville washers to resist normal lateral pressure on a locked door without triggering a false alarm, unlike Heiland '830 which expressly uses a mortise lock having a horizontally moveable lockbolt, and it is the Heiland lockbolt itself which presses up and thus actuates the Heiland-required piezoelectric element for alarm triggering. In contrast, the present invention uses a simplified, and thus less expensive electrical contact switch. Unlike Heiland, the present invention has resilient means, preferably Belleville washers, to cushion and absorb lateral force up to the point where their resistance is overcome by a sufficient force, as when the door is under the force of an intruder.

By the use of resilient means, preferably Belleville washers, the present invention solves the problem identified by Heiland at Column 1 lines 25–35 wherein Heiland did not know how to adapt what he describes as the relatively long travel required by an electrical contact switch to an alarm.

A further major distinction between Heiland '830 and the present invention is that the present invention is a self-contained door-lock-alarm assembly. The alarm sound comes directly from the present invention when it is triggered—unlike Heiland '830 which sends an output to a remote alarm and does not comprise an alarm-and-lock assembly as does the present invention.

U.S. Pat. No. 5,489,890 to Moser discloses a portable alarm device for entryway monitoring. It is mounted by suction cups to a convenient surface. However, it depends upon the pulling force of a suction cup mounted on a door to be monitored and is thus in the nature of a trip-wire alarm system, unlike the present invention which is permanently and resiliently mounted upon a door to be protected and comprises a lock-and-alarm assembly.

U.S. Pat. No. 5,469,139 to Ko discloses a latch and alarm device for securing a door which uses a latch mechanism and a force sensor with an alarm unit. However, the '139 patent to Ko requires that a rotatable latch be mounted to the frame of a door and which captures an arm mounted to a plate on the door. A battery-operated alarm is also mounted on the plate attached to the door. When the latch is closed and an on/off switch is set to on, any force on the door exceeding a nominal amount activates the alarm. Unlike the present invention, the '139 patent to Ko is a latch—and thus is not a dead bolt lock assembly. Ko's invention therefore provides the inferior security of a latch as compared to the higher degree of intrusion resistance offered by a dead bolt. Further, the invention of Ko is not a substitute for a door lock—an additional lock is still needed even with Ko's invention installed. Ko's invention also does not require a resilient mounting means as the present invention does and Ko does not employ or embody the well-known vertical dead bolt lock as does the present invention.

U.S. Pat. No. 5,461,365 to Schlager et. al. discloses a personal alarm system including a monitoring base station and one or more remote sensing units in two-way radio communication requiring an electronic handshake between the base station and each remote unit to assure system reliability. Schlager's invention is thus more complicated than the present invention and it is an alarm system—and not a deadbolt lock, as is the present invention. Force resistance and resilient mounting means which are critical to the present invention, play no part in the invention of Schlager.

U.S. Pat. No. 5,354,157 to Wells et al. Discloses the use of Belleville washers—but not in the context of securing or alarming a premises door. Wells discloses a device for connecting a shank to a probe using Belleville washers, whose spring-resilience is utilized.

U.S. Pat. No. 5,347,262 to Thurmond et al. Discloses a theft deterrent device providing force-sensitive tamper detection using a pin-and-clutch. When a sufficient separating force is applied to the pin inserted into the clutch, the pin separates from the clutch, triggering the alarm. The invention of Thurmond is not described as applied to a door nor is it described as being part of a lock-and-alarm assembly nor does it require the use of resilient mounting means such as the Belleville washers of the present invention.

U.S. Pat. No. 5,191,314 to Ackerman et al. discloses a combination anti-theft lock and alarm to prevent the theft or displacement of portable protected property. Ackerman '314 has a housing with an audible alarm there within and uses a flexible, electrically conductive locking cable having a first end fixed to the housing and an opposite free end detachably connected to the housing. If either the cable or housing is vandalized or severed in a theft attempt, the alarm will sound. Unlike the present invention, no resilient mounting means is taught nor is the device combined with a well-known vertical dead bolt lock as is taught by the present invention. Ackerman protects portable property while the present invention is fixedly installed as a premises door lock.

U.S. Pat. No. 5,311,168 to Pease, Jr. et al. describes a deadbolt door alarm which requires a horizontal deadbolt, unlike the present invention, and which has a piezoelectric sensor alarm triggered by motion or vibration and where false alarms are prevented by timing and not by resilient washers as in the present invention.

The present invention, simply put, provides a vertical operable dead bolt door lock of the kind well known by urban apartment dwellers. The lock is surrounded by and attached to an alarm housing box, and the dead bolt lock is provided with the conventional striker plate which is screwed into the door frame in the well known fashion in a position corresponding to the locking member of the vertical dead bolt lock.

The dead bolt lock has a locking member which moves vertically from an unlocked position to a locked position. When the door on which the lock has been mounted is closed, the locking member moves vertically to enter and to engage the striker plate upon the door being locked. With the locking member engaged by the acceptor plate, the lock and acceptor plate have heretofore formed the hardware combination which comprised the door lock.

Such lock hardware may be defeated by force. An intruder attempting forced entry upon a door locked with the above-described vertical dead bolt lock can overcome the integrity of the screws holding the dead bolt lock itself attached to the door and/or overcome the integrity of the screws holding the striker plate into the frame of the door. In any event, the door, the lock and/or the striker plate and frame can be broken with the application of sufficient force by a determined intruder.

Although applying force will inevitably create some noise, such a conventional vertical dead bolt lock will not, by itself, transmit an alarm or sound an alarm loudly in the intruder's immediate vicinity during the intruder's activity. But the present invention does exactly this job, and draws public attention to the source of the alarm, and thus to the intruder and his criminal activity during the happening thereof, thereby providing one of the strongest of all intruder deterrents—the threat of being immediately caught in the act and recognized by witnesses.

What has been needed and what the present invention also provides is a lock and alarm combination where the alarm is triggered by force upon the door.

In addition, the present invention provides a device which is inexpensive and uncomplicated to manufacture, and uses conventionally available hardware and alarm electronics throughout. Especially useful is the incorporation by the present invention of a completely conventional dead bolt lock, which makes installation of the present invention identical to the installation of a conventional lock which existing carpenters and lock installers will find easy and familiar.

OBJECTS OF THE INVENTION

To overcome the disadvantages of the prior art, it is an object of the present invention to provide an inexpensive forced entry deterrent system in combination with a vertically operated dead bolt lock.

It is a further object of the present invention to provide an intrusion deterrent which transmits an alarm only when sufficient force is applied to the protected door to approach the force necessary to defeat ordinary lock hardware, thus reducing false alarms by requiring more than a normal amount of lateral force being applied to the protected door in order to trigger the alarm.

It is yet another object of the present invention to provide an intrusion alarm and deterrent combination which is easy and familiar to install.

It is another object of the invention to provide an intrusion deterrent system which employs conventional, and thus inexpensive hardware.

It is yet another object of the present invention to provide an alarm protection which is totally passive since the alarm does not require user activation, i.e., the user does not have to turn it on or off upon entering or leaving the alarm-protected premises door.

It is also an object of the present invention to overcome the disadvantages of the prior art.

SUMMARY OF THE INVENTION

In keeping with the aforesaid objects of the invention and others which may become apparent, the present invention provides an apparatus and method for deterring and preventing forced entry intrusion into residential and commercial premises. The device is a combination vertically operated dead bolt door lock surrounded by an alarm housing having battery means, a loud speaker, and a contact switch connected to the required electric circuit. The striker plate is mounted to the door frame in the usual fashion, but the lock is not mounted to the door at all, it is rather attached in suspension within the alarm housing.

It is the box-like alarm housing which surrounds the door lock and it is the alarm housing attached to the door, and the lock within the housing is offset so as to float in spaced-apart relationship from the door on which the alarm housing is installed.

The box-like alarm housing is substantially a flat generally rectangular box made out of suitable premises security hardware, such as steel or other materials which are similarly durable. The alarm housing box has an outer side and an inner side, the inner side being the side facing or closest to the premises door being protected by the present invention.

The inner side of the alarm housing box is the side closest to or facing and/or in contact with the door to be protected from intrusion when the device of the present invention is installed. The inner side of the alarm housing box is open, meaning that it is not provided with a solid covering. The inner side of the alarm housing box is defined or demarked by the edge of the alarm housing which comprises the inner side of the walls of the alarm housing in the same manner that any open, coverless rectangular box resting upon a flat surface naturally has walls and a bottom but also has an open side defined by the edge comprising the walls of the box at the place where an absent box cover could be positioned.

Such a hypothetical coverless rectangular box, like the alarm housing box of the present invention, has an open, non-material side which is defined by an edge comprised of the walls of the box.

The outer side of the alarm housing box faces the premises being protected, and the outer side of the alarm housing is the side of the box which the premises-occupant user will normally see when the device is installed.

The inner side of the alarm housing box is open and is defined by an inner edge, the inner edge in turn comprising the inner side of the walls of the alarm housing box. The alarm housing box surrounds the dead bolt door lock fastened to the housing, and, critically for the present invention, the edge comprising the walls of the alarm housing box extends slightly beyond the inner side of the door lock when the lock is attached within the alarm housing box. This slight but critical extension of the alarm housing box inwardly creates an offset, so that the dead bolt door lock is slightly recessed within the alarm housing box when the lock is installed.

The magnitude of the critical recess by which the dead bolt lock is offset from the inner door-contact edge of the alarm housing body is from about 30/1000 inches to about 200/1000 inches, but preferably is about 100/1000 inches.

The effect of the critical recessing of the dead bolt door lock is that when the alarm housing box containing the dead bolt door lock is installed upon a door to be protected, it is only the inner edge of the alarm housing box which contacts the door to be protected, and critically, the dead bolt door lock itself does not contact the door being protected, except insofar as the dead bolt locking element engages the striker plate fastened to the frame of the door. But the dead bolt lock body itself does not otherwise contact the surface of the door which it is protecting.

Instead, the dead bolt lock is installed suspended within the alarm housing box by at least one, and preferably two machine screws inserted through apertures in the outer side of the alarm housing box and grabbing and holding the threads of corresponding threaded bores provided in the body of the dead bolt lock.

Critically, the installation of the dead bolt lock within the alarm housing box is also provided with resilient spring means so that, as installed by attachment to the alarm housing box, the dead bolt lock may move resiliently relative to the alarm housing box upon the application of force. When an intrusion force is applied to a locked door being protected by the present device, the alarm housing, being attached to and in contact with the door surface, will necessarily move along with the door against which the intruder is applying force.

However, the dead bolt lock body is not actually in contact with the door being subject to force by the intruder, due to the critical recess described above. In fact the dead bolt door lock is floating in attached suspension, the suspension being provided by the at least one machine screw and resilient spring means combination attaching the lock to the alarm housing but not directly to the door. The only other mechanical contact made by the dead bolt lock body is the contact made by the engagement of the vertical locking member with the striker plate, which striker plate is not attached to the door, but rather to the door frame.

When an intrusion force is applied to a locked door, it is the door, and not the frame which bears the lateral intrusion force. The door may yield under a sufficient intrusion force but the frame, typically not being subjected to any force during an intrusion, will remain stationary.

Since the engaged striker plate will remain fixedly stationary during an intrusion attempt, the engagement of the vertically operable locking member of the vertical dead bolt door lock will restrain the dead bolt lock body from moving. But, since the lock body is restrained by the door-frame striker plate but the alarm housing box attached directly to the door being forced is not so restrained, there will be a resultant prying-apart force applied between the dead bolt door lock and the alarm housing box as a consequence of the intruder's lateral force upon the door being attacked.

Parenthetically, a vertically operating dead bolt lock is critical to the present invention, and the vertical dead bolt lock required by the present invention as a component in combination with the alarm housing herein provided for, is in comparison to other kinds of dead bolt locks, such as dead bolt locks which have locking members with horizontal movements. Such a conventional vertically operable dead bolt door lock is well known in the premises security art, and is very familiar to lock smiths, lock installers, builders and carpenters. It is typically installed upon a door to be protected with four wood screws installed through bores provided in the outer side of the alarm housing as well as the body of the dead bolt lock.

The present invention maintains the very same familiar installation with, preferably the same hardware, meaning preferably the conventionally familiar four wood screws used to attached the related-art vertical dead bolt lock to a door. But in the present invention, the alarm housing box is provided with at least one, and preferably four apertures corresponding to the mounting screw bores of the vertical dead bolt lock body. The familiar installation using wood screws is preserved with the present invention, taking advantage of the ease and familiarity of lock installation which presently exists.

In the present invention, however, the at least one installation wood screw is inserted into the at least one aperture of the alarm housing box, the screw extending through the bore in the dead bolt lock, and contacting the door onto which the alarm housing box is being attached. Although the mounting screws go through the dead bolt lock, they do not grab or clamp the dead bolt lock, thus allowing the dead bolt lock to slide upon them in keeping with the remainder of the description of the present invention.

The happening of a premises intrusion effort against a door being protected by the present invention will mean that the locked door is subjected to lateral force by an intruder attempting to open it. Upon such an intrusion attempt, the door, together with the alarm housing will be shoved inward toward the premises by the intruder.

But the lock floating within the alarm housing will be restrained by its engagement with the striker plate mounted to the door frame. Because the lock is restrained from moving but the alarm housing is not, there will be relative movement therebetween, restrained only by resilient spring means, which are preferably washers and preferably mounted upon the screws mounting the lock to the alarm housing.

The spring washers are preferably Belleville washers. The tension upon the Belleville washers is set so that the dead bolt lock is held firmly against the alarm housing.

When the resilience of the spring washers is overcome—which happens not by incidental force applied to the door, but only by a sufficiently strong and violent force applied by the intruder, the spring resilience of the Belleville washers or other suitable resilient spring means will be overcome. The overcoming of the resilient spring means in the aforedescribed manner allows for the relative motion previously described to occur. If, and only if the said relative motion exceeds a calibrated distance, the alarm is then triggered.

The application of non-critical lateral force to the locked door protected by the present invention may merely be absorbed by the Belleville washers or other spring means used to resiliently suspend the dead bolt lock within the alarm housing box. Only when the spring resilience of the spring means, or preferably Belleville washers, is overcome, will there be motion of the dead bolt lock relative to its surrounding alarm housing box.

Once the spring means applied to the dead-bolt-suspending machine screws is overcome, upon continuing and increasing intrusion force, there will be motion of the dead bolt lock relative to the alarm housing, in turn when the aforesaid calibrated travel limit is reached an electrical alarm contact switches on to activate a piercing alarm sound, and causing the intruder to be deterred from continuing to try to force entry to the premises.

The relative motion needed to operate the electrical contact switch housed within the alarm housing is from about 1/1000 inches to about 50/1000 inches depending on the stiffness of the Belleville washers, preferably, or springs or other resilient resistance means employed. Preferably the travel distance of the dead bolt lock relative to the alarm housing box needed to activate the alarm-triggering contact switch is about 20/1000 inches for manufacturing convenience.

For practical reasons, the preferred Belleville washers, or, alternately other resilient spring means, are to be selected with appropriate stiffness to allow for about 20/1000 inches travel when a lateral force of from about 75 to about 100 pounds is applied to the door being protected by the present invention. The range of the aforesaid lateral force is such that no person would be likely to apply it simply by leaning against the protected door. On the other hand, such afore-described lateral force is far below the holding power of the wood screws used on the alarm box or the striker plate, and thus the alarm will trigger upon application of far less lateral force than would be needed to cause the aforesaid wood screws to fail and the protected door thus to be broken down and opened by brute force.

The present invention preferably is provided with at least one timing circuit for producing an alarm actuation of a selected duration of time. Thus, when the alarm is triggered, it only produces sound for a preselected duration. preferably two minutes. After the expiration of selected alarm actuation time period, the timing circuit stops the actuation and the device is ready to be triggered again.

BRIEF DESCRIPTION OF THE DRAWINGS

The invention can best be understood in conjunction with the drawings, in which.

DETAILED DESCRIPTION OF THE DRAWINGS

Figure 1:
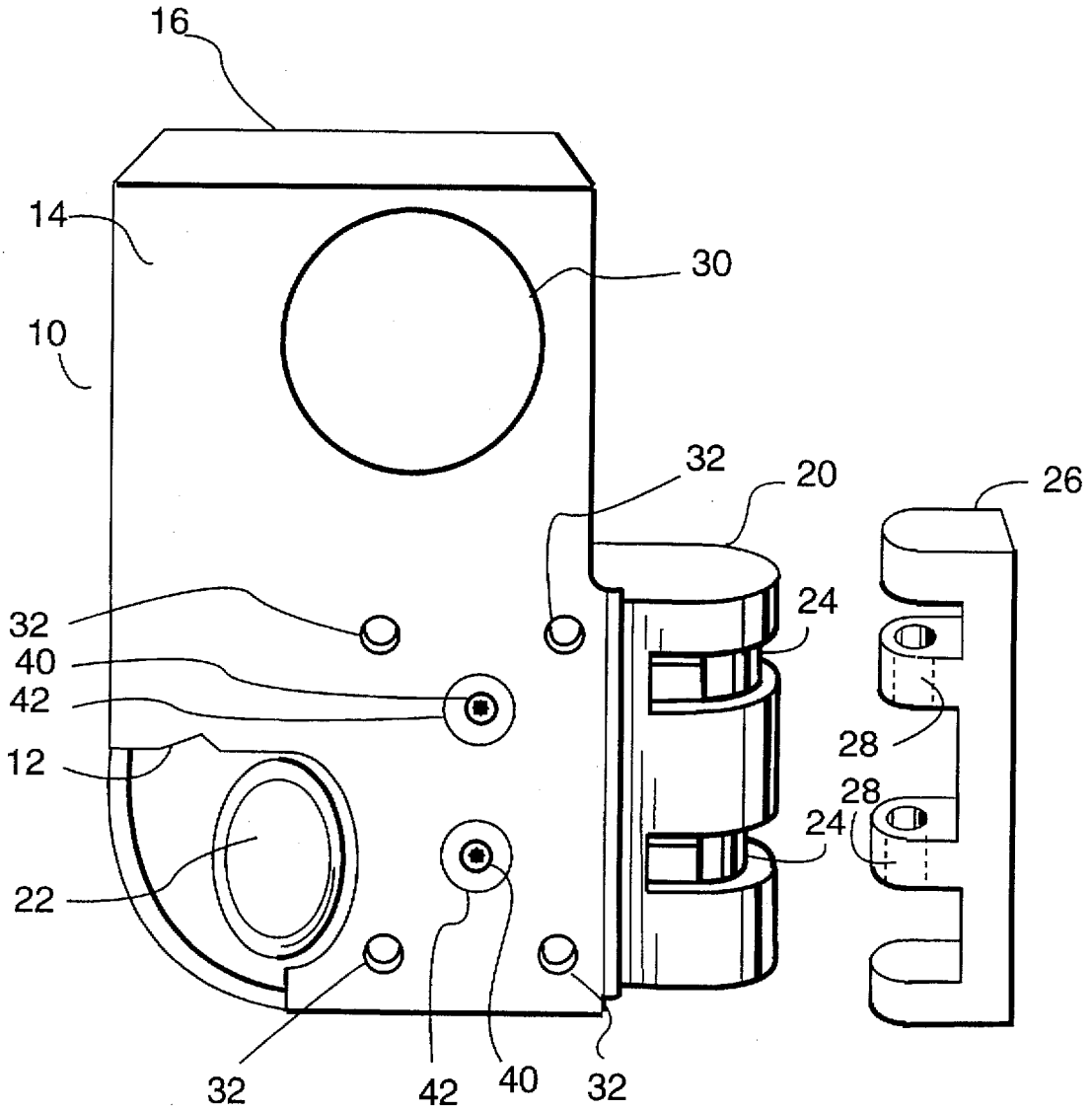
FIG. 1 shows a front view of the outer side of the combination vertical dead bolt lock and alarm housing box of the present invention.

FIG. 1 is a front view of the outer side of the combination vertical dead bolt lock and alarm housing box of the present invention with alarm housing box 10, having front outer side 14, rear inner side edge 16, and cut away opening 12 for permitting the dead bolt lock to project through the alarm housing box 10 for permitting user access 22 to the door lock mechanism vertical dead bolt lock 20.

FIG. 1 shows vertical locking member 24 in the locked position. In the unlocked position, member 24 is retracted, permitting lock 20 to correspond with the striker plate 26 permitting locking member 24 to engage with aperture 28 in striker plate 26.

Mounting screw apertures 32 in alarm housing box 10 accept mounting screws for mounting alarm housing box 10 to a door to be protected from intrusion.

Machine screws 40 comprise the suspendable attachment means for attaching lock 20 to alarm housing box 10. Machine screws 40 project through apertures in alarm housing box 10 and are threadably inserted into corresponding threaded bores provided in lock 20, thereby suspendably attaching lock 20 to alarm housing box 10.

Resilient Belleville washers 42 are mounted upon machine screws 40 upon the outer side 14 of alarm housing box 10. The Belleville washers provide machine screws 40 with resilience such that when a prying-apart force is applied between lock 20 and alarm housing box 10, Belleville washers 42 resist the attempted motion of machine screws 40. Only when the resilience of Belleville washers 42 is overcome will lock 20 move in a rearward direction in relation to alarm housing box 10, thus actuating an internal else-where shown electrical contact switch which in turn triggers the alarm.

Figure 2:
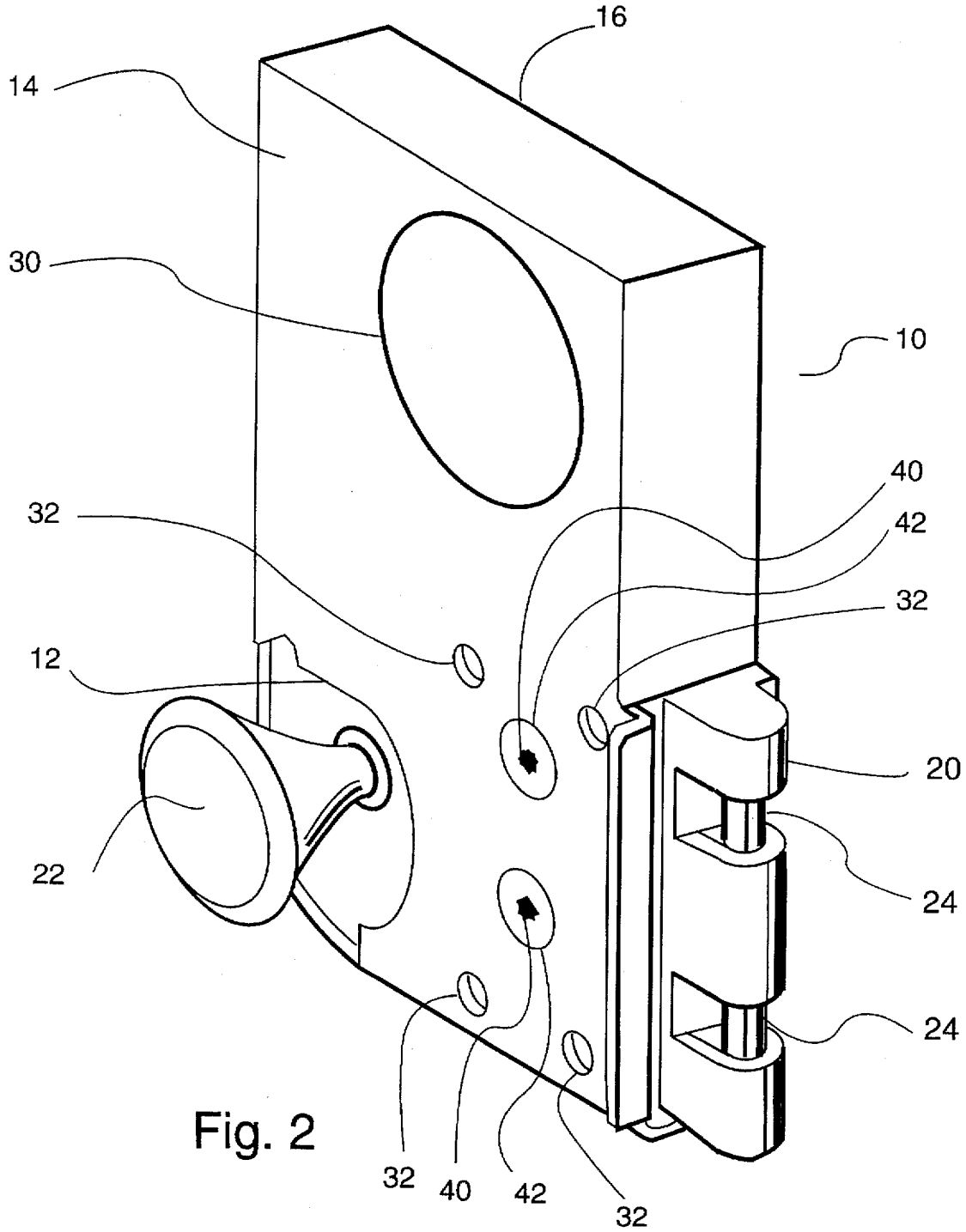
FIG. 2 is a front, outer-side perspective view of the present invention.

FIG. 1 also shows alarm siren 30 mounted within alarm housing box 10, FIG. 2 shows a front, outer-side perspective view of the present invention additionally illustrating cut away 12 in alarm housing box 10, machine screws 40 with Belleville washers 42 connecting lock 20 suspendably to alarm housing box 10, lock 20 having locking member 24, loud speaker 30 mounted in alarm housing box 10 and mounting screw apertures 32 in alarm housing box 10. Alarm housing box 10 is shown having outer side 14 and rear inner edge 16.

Figure 3:
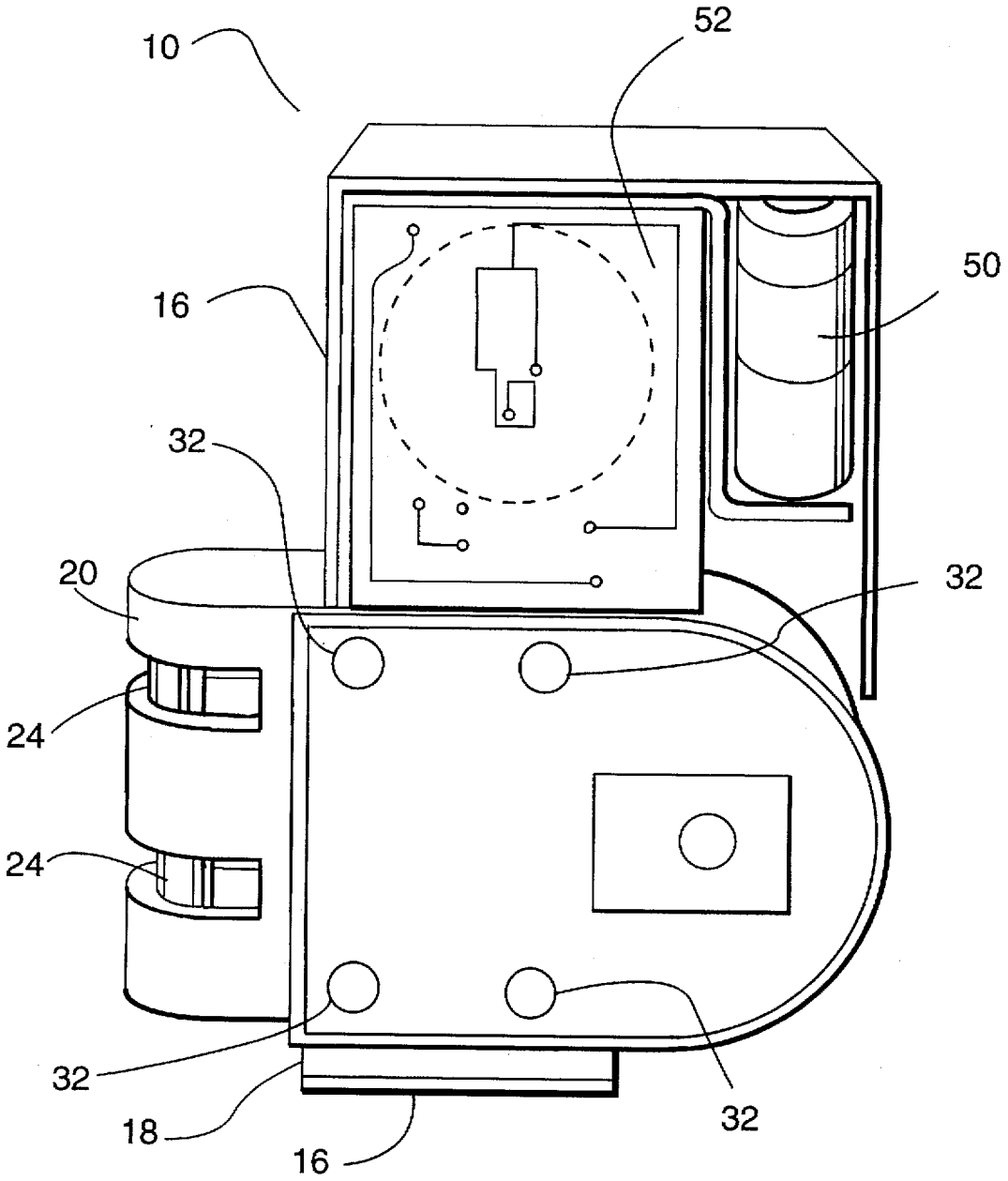
FIG. 3 is a rear, inner-side perspective view of the present invention.

FIG. 3 shows a rear, inner-side perspective view of the present invention having battery 50 within alarm housing box 10. Edge 16 of alarm housing box 10 defines the open rear, or inner side of box 10. Cut away opening 18 is provided in alarm housing box 10 for permitting the dead bolt lock to project through the cut away opening 18 for permitting the at least one dead bolt locking member to project beyond the dimensions of alarm housing box 10 so as to be able to engage with correspondingly positioned door frame-mounted striker plate 26 FIG. 1 when the door is closed. Alarm circuitry 52 is also shown disposed within alarm housing box 10 as are mounting screw apertures 32 which are shown upon lock 20 in correspondence with apertures 32 in alarm housing box 10 in FIGS. 1 and 2, so as to permit through-projection of mounting screws from the outer side 14 of alarm housing box 10 shown in FIGS. 1 and 2.

Figure 4:
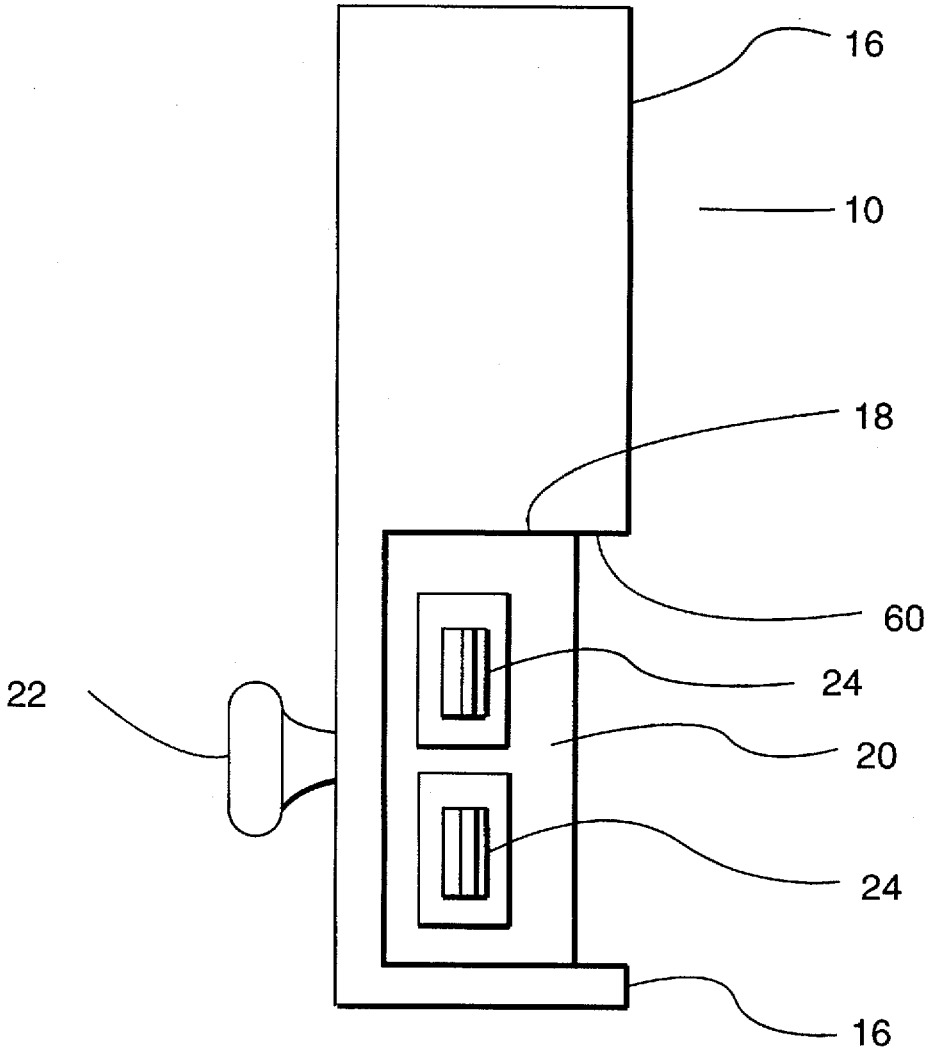
FIG. 4 is a side view of the present invention showing the recess of the vertical dead bolt lock within the alarm housing box of the present invention.

FIG. 4 shows a side view of the present invention showing the recess 60 of the vertical dead bolt lock within the alarm housing box of the present invention relative to alarm housing box 10, for permitting the installation of alarm housing box 10 with edge 16 in contact with the door to be protected but without contact between lock 20 and the door to be protected.

Figure 5A:
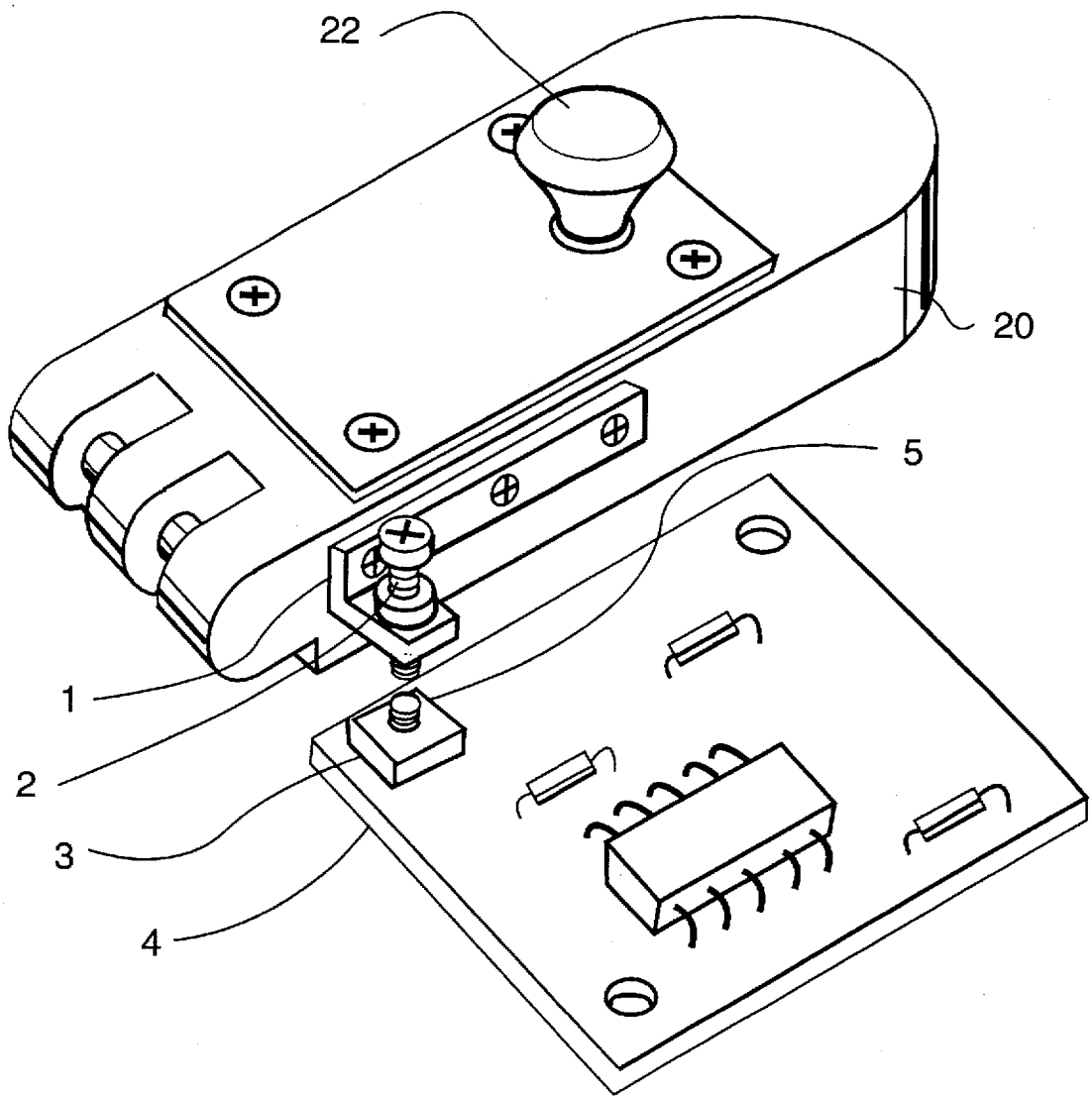
FIG. 5*a* is an exploded view of the calibration screw-triggering switch combination.

FIG. 5*a* shows a perspective view of lock 20 with L-bracket 1 mounted thereon. L-bracket 1 accommodates screw 2. Printed circuit board 4 is provided with trigger switch 3. Between screw 2 and trigger switch 3 there is a small gap 5 of about 10/1000 inch to about 50/1000 inch, but preferably from about 15/1000 to about 25/1000 inches.

Figure 5B:
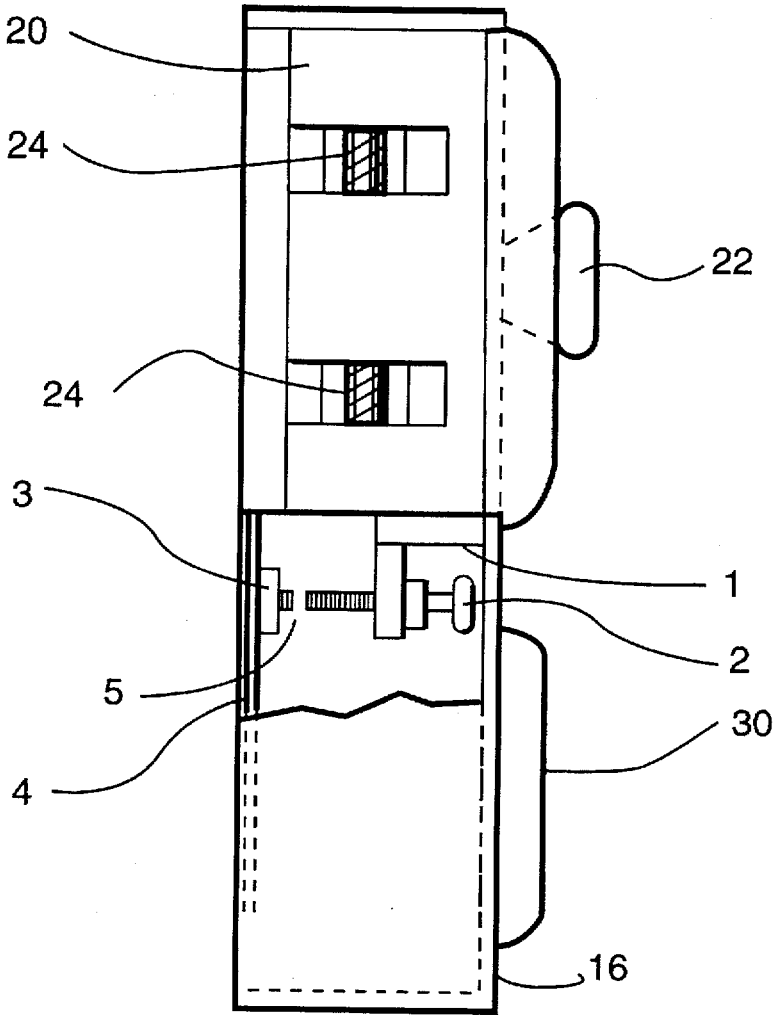
FIG. 5*b* shows a side view of the calibration screw-triggering switch combination showing the gap between the screw and the switch on the bottom

FIG. 5*b* shows a side cut-away view of lock 20 with L-bracket 1, further showing screw 2 and trigger switch 3 with small gap 5 therebetween.

Due to the existence of gap 5 no triggering of the alarm of the present invention can occur under normal use. But when force is applied, as by an intruder trying to force open the door protected by the present invention, the trigger switch assembly comprised of trigger switch 3, which is mounted on printed circuit board 4 which is in turn attached to alarm housing box 16 undergoes motion along with the door to which the trigger switch assembly is attached.

But when the aforesaid trigger switch assembly is in motion in response to force applied to the door as described, screw 2 does not move correspondingly because screw 2 is attached to L-bracket 1 which is in turn attached to lock 20 which in turn remains stationary because it is secured by the locking member 24 engaging striker plate 26 which striker plate is mounted on the door frame. If the force applied to the door is sufficiently large, the resilience of the Belleville washers 42 (shown elsewhere) is overcome, gap 5 closes under the relative motion of screw 2 and trigger switch 3 toward each other, leading ultimately to the triggering of trigger switch 3 and the sounding of the alarm.

Figure 6:
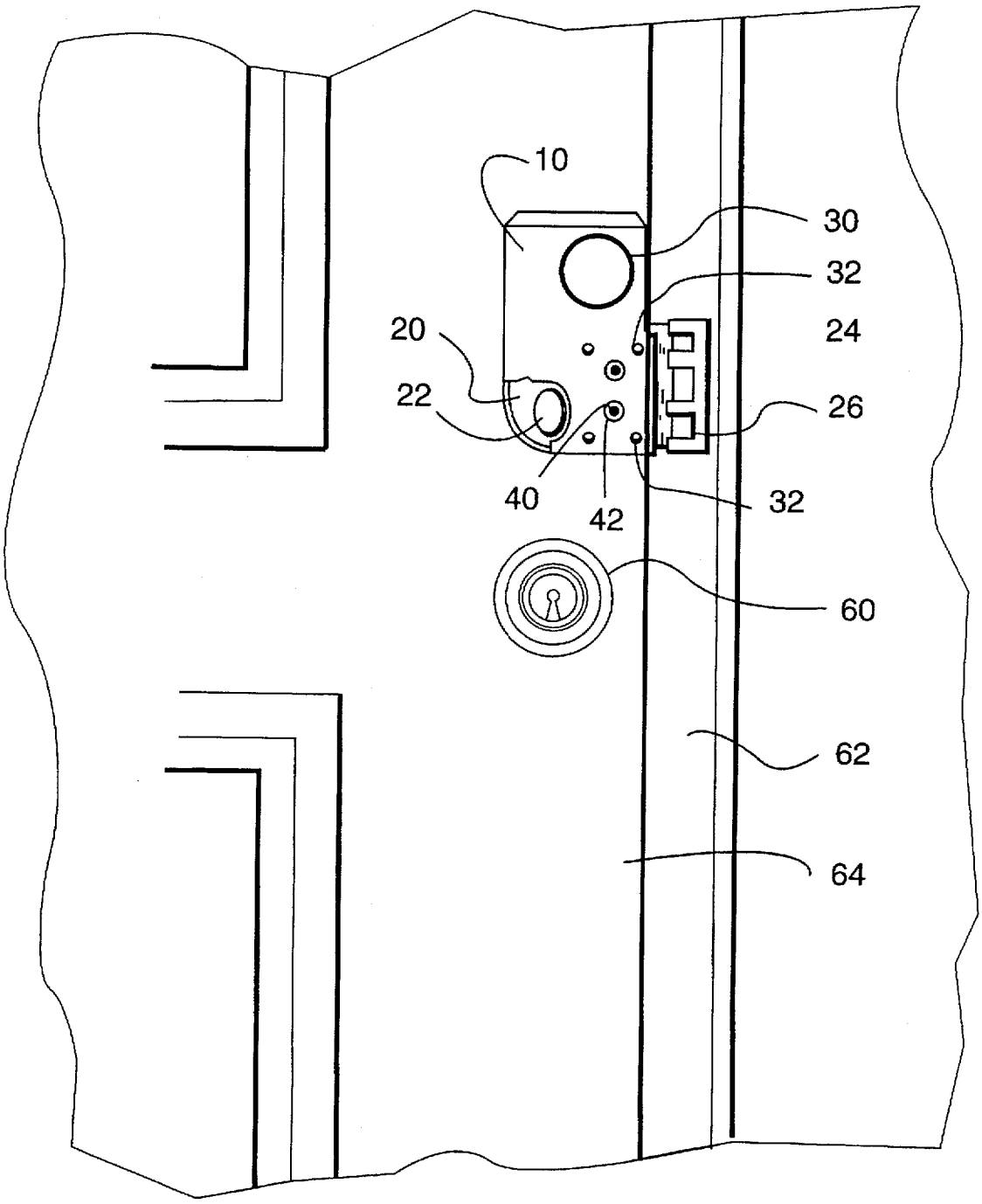
FIG. 6 is a front cut-away view of a premises door and door frame with the present invention mounted thereon.

FIG. 6 shows a front cut-away view of the present invention mounted on door 64 shown closed, having door frame 62 with door knob 60. As shown, housing box 10 connected to lock 20 is positioned so as to engage with correspondingly positioned striker plate 26 mounted on door frame 62 when the door is closed. When locking member 24 is in the unlocked position, no engagement is made with striker plate 26, thus allowing the door to open. When locking member 24 is in its locked position, it engages striker plate 26. When force is placed upon door 64, as it would be by an intruder trying to force it open, door 64 will move, taking housing 10 with it, since housing 10 is provided with mounting screw apertures 32 to accept mounting screws for mounting alarm housing box 10 to door 64.

When box 10 together with door 64 move rearward in response to an intruder's force, lock 20, which is only attached to box 10 and not to door 64, cannot move in harmony with box 10 and door 64, because lock 20 is restrained by virtue of the engagement of locking member 24 with striker plate 26 mounted to door frame 62. Thus, lock 20 is restrained from rearward motion but door 64 and box 10 are not similarly restrained, allowing for the application of pulling-apart force between lock 20 and box 10. Such separating force is communicated to Belleville washers 42 because machine screws 40 are used to suspendably connect box 10 to lock 20.

As stated above, only when the separating force, supplied by an intruder, is sufficient to overcome the resilience of the Belleville washers 42, will lock 20 actually move, thus permitting the electrical contact which triggers the alarm as above indicated.

Further modifications may be made to the present invention without departing from its scope, as noted in the appended claims.

What is claimed is:

1. A vertical deadbolt intrusion deterrent device for protecting a premises from intrusion, comprising at least one lock in combination with an intrusion alarm having alarm transmission means and alarm triggering means, the premises having at least one door having a door frame, the at least one door with door frame comprising the premises access means to be protected from intrusion; wherein also the intrusion alarm comprises an alarm housing surrounding the at least one lock, the at least one lock further comprising a vertically operable dead bolt lock having at least one dead bolt locking member capable of moving vertically between a locked position and an unlocked position, the at least one dead bolt lock also having at least one striker plate fixedly mounted upon the door frame of the premises being protected in a position corresponding to the vertical movement of the at least one dead bolt locking member, the at least one striker plate for accepting, engaging and securely holding the at least one dead bolt locking member in its locked position, and wherein the alarm housing being provided with at least one alarm-housing mounting screw aperture therethrough and the at least one dead bolt lock is also provided with at least one lock mounting screw aperture therethrough, the respective housing and lock mounting screw apertures being in registry for accepting at least one mounting screw for attaching the alarm housing to the door of the premises to be protected.

2. The device of claim 1, the at least one dead bolt lock being attached within the alarm housing by suspension attachment means so as to support the dead bolt lock in suspension within the alarm housing, with the mounting screw apertures of the alarm housing aligned with the at least one mounting screw aperture of the dead bolt lock.

3. The device of claim 2 where the alarm housing has a bottom and at least one cut away opening for permitting the dead bolt lock to project through the cut away opening for permitting the at least one dead bolt locking member to engage with correspondingly positioned door frame-mounted striker plate when the door is closed.

4. The device of claim 3, the alarm housing having an alarm actuating electrical circuit having at least one alarm-triggering electrical contact switch, at least one suitable loud speaker, at least one timing circuit for producing an alarm actuation of a selected duration of time, the device further comprising an energy storage means for providing electrical energy to the alarm circuit and at least one loud speaker for creating a piercing intruder-deterrent sound, the contact switch, timing circuit, energy storage means and loud speaker being in suitable electrical connection with each other.

5. The device of claim 4 wherein the at least one dead bolt lock is resiliently suspended within the alarm housing by resilient suspension means wherein the resilient suspension means comprises, in combination, at least one lock attachment aperture in the alarm housing and at least one corresponding suitably threaded lock attachment aperture in the at least one dead bolt lock for suspendably attaching the at least one dead bolt lock to the alarm housing by at least one machine screw, the at least one machine screw extending through the at least one lock attachment aperture in the alarm housing, and engaging corresponding threads of the at least one threaded lock attachment aperture, the at least one machine screw being further provided with resilient spring means for allowing motion of the at least one machine screw relative to the alarm housing.

6. The device of claim 5, the alarm housing having an open side exposed to the door on which the alarm housing is mounted, the alarm housing open side demarked by an open-side edge, and wherein the dead bolt lock suspendably mounted within the alarm housing has an inner side also exposed to the door on which the alarm housing is mounted, the edge-demarked open side of the alarm housing being substantially coplanar with the inner side of the dead bolt lock but being offset therefrom by an offset of from about 30/1000 inches to about 200/1000 inches, whereby, upon installation of the device of the present invention upon a door to be protected from intrusion, the open-side edge of the alarm housing contacts the door but the dead bolt lock, by reason of being offset therefrom, does not contact the door to be protected from intrusion.

7. The device of claim 6 wherein the offset is from about 75/1000 inches to about 125/1000 inches.

8. The device of claim 7 wherein the offset is about 100/1000 inches.

9. The device of claim 8 wherein the resilient spring means for resisting motion of the at least one machine screw relative to the alarm housing comprises at least one spring washer mounted coaxially upon the at least one machine screw.

10. The device of claim 9 wherein the resilient spring means for resisting motion of the at least one machine screw relative to the alarm housing comprises at least one Belleville washer.

11. The device of claim 10 wherein the alarm energy storage means comprises at least one battery directly connected to the alarm actuating electrical circuit so as to eliminate the need for the user to turn the alarm on or off.

12. A method of deterring forced premises intrusion and protecting a premises from forced entry, by producing an alarm output and/or sound upon the occurrence of an attempted forced intrusion, comprising the steps of a. attaching a vertically operable dead bolt lock suspendably within an alarm housing so as to provide an offset relationship therebetween;

b. attaching the alarm housing directly to and in contact with a premises door to be protected from intrusion;

c. maintaining the door and the lock in spaced apart relationship;

d. affixing a striker plate to the frame of the door to be protected in a position corresponding to the dead bolt lock when the door is closed;

e. providing resilient attachment means for attaching the dead bolt lock to the alarm housing so as to allow relative motion therebetween upon the occurrence of an intrusion force being applied to the locked door; and f. allowing the restraint provided by the striker plate to create motion of the locked dead bolt lock relative to the alarm housing to actuate an electric switch, in turn triggering the alarm.

13. The method of claim 12 wherein the resilient attachment means for attaching the dead bolt lock to the alarm housing comprises, in combination, at least one machine screw with at least one threaded aperture therefor in the dead bolt lock, with a corresponding aperture in the alarm housing for insertion of the machine screw therethrough so as to attach the alarm housing to the dead bolt lock, the combination further having resilient spring means for urging the at least one attachment machine screw apart from the alarm housing when the at least one machine screw is installed through the alarm housing aperture and threadably secured in the dead bolt lock threaded aperture.

14. The method of claim 13 wherein the resilient spring means for urging the at least one attachment machine screw apart from the alarm housing comprises at least one Belleville washer.

15. The method of claim 14 using the device of claim 11.

16. The method of claim 14 using the device of claim 1.

17. The method of claim 12 using the device of claim 1.

18. The method of claim 12 using the device of claim 11.

* * * * *